US012389956B2

(12) United States Patent
Byrne

(10) Patent No.: US 12,389,956 B2
(45) Date of Patent: Aug. 19, 2025

(54) BANDED SPORTS BRA

(71) Applicant: Patrick Byrne, Foley, AL (US)

(72) Inventor: Patrick Byrne, Foley, AL (US)

( * ) Notice: Subject to any disclaimer, the term of this patent is extended or adjusted under 35 U.S.C. 154(b) by 0 days.

(21) Appl. No.: 18/531,443

(22) Filed: Dec. 6, 2023

(65) Prior Publication Data

US 2024/0180266 A1 Jun. 6, 2024

Related U.S. Application Data

(60) Provisional application No. 63/430,494, filed on Dec. 6, 2022.

(51) Int. Cl.
*A41C 3/12* (2006.01)
*A41C 3/00* (2006.01)

(52) U.S. Cl.
CPC ..... *A41C 3/0057* (2013.01); *A41C 3/0014* (2013.01); *A41C 3/12* (2013.01)

(58) Field of Classification Search
CPC ..... A41C 3/0014; A41C 3/12; A41C 3/0057
USPC ..... 450/7
See application file for complete search history.

(56) References Cited

U.S. PATENT DOCUMENTS 7,435,155 B2 * 10/2008 Reinisch ..... A41C 3/0057 450/59
7,850,508 B2 * 12/2010 Pitarelli ..... A61F 13/145 450/86
11,696,606 B2 * 7/2023 Inselberg ..... A41C 3/0085 450/39
2006/0252346 A1 * 11/2006 Reinisch ..... A41C 3/0028 450/86
2011/0081827 A1 * 4/2011 Williams ..... A41C 3/0021 450/86
2012/0028541 A1 * 2/2012 Donnelly ..... A41C 3/0021 450/86
2013/0065486 A1 * 3/2013 Hansen ..... A41C 3/0064 450/59
2019/0098940 A1 * 4/2019 Huffa ..... A41C 3/124
2019/0174840 A1 * 6/2019 Paulson ..... A41C 3/0014
2020/0187570 A1 * 6/2020 Huffa ..... A41C 3/126
2020/0288790 A1 * 9/2020 Blecha ..... A41C 3/0057
2020/0288792 A1 * 9/2020 Blecha ..... A41C 3/0021
2021/0169153 A1 * 6/2021 Inselberg ..... A41C 3/0057
2023/0037258 A1 * 2/2023 Huffa ..... A41C 3/124
2023/0363466 A1 * 11/2023 Huffa ..... A41C 3/0057
2023/0397672 A1 * 12/2023 Inselberg ..... A41C 3/0057
2024/0180266 A1 * 6/2024 Byrne ..... A41C 3/0014

* cited by examiner

*Primary Examiner* — Gloria M Hale
(74) *Attorney, Agent, or Firm* — C. Brandon Browning; Maynard Nexsen PC

(57) ABSTRACT

A banded sports bra for supporting breasts during exercise or other rapid movement of a person is provided. The banded sports bra has several pathways for bands that allow support of the breasts during oblique and downward breast motion. The banded sports bra can have left and right primary bands that form a rotated "S" shape about the breasts to reduce unwanted movement of the breasts. The banded sports bra can also have a secondary band that is provided under the breasts to reduce downward motion of the breasts. The primary and secondary bands can be adjustable to control the tension provided by the bands at tension adjustment regions with adjustment straps.

20 Claims, 16 Drawing Sheets

BANDED SPORTS BRA

CROSS-REFERENCE TO RELATED APPLICATIONS

This application claims the benefit of U.S. Provisional Application No. 63/430,494, entitled "Banded Sports Bra," filed Dec. 6, 2022, which application is hereby incorporated by reference in its entirety.

BACKGROUND

Sports bras or athletic bras are generally utilized to restrict unwanted movement of breasts during exercise or activities. Typical sports bras do so by compressing the breasts in a uniform manner using stiff materials, a close fit, and/or compression features. However, the uniform compression of the breasts can be uncomfortable to the person as pressure and friction can be higher in some areas of the person's chest and torso. Further, uniform compression does not efficiently counteract breast movement during exercise.

When a person is engaged in running as an activity or participating in a sport that involves running, the person's breasts move in a particular manner. Studies have shown that when a person runs, the person's breasts move in an oblique manner with breasts moving in opposite directions during the majority of the movement. The oblique movement of the breasts is a result of the rib cage rotation of the person resulting in contralateral reciprocation. Thus, when the left breast moves upward and toward the midline of the person, the right breast moves downward and laterally away from the midline of the person. Further, when the person's foot strikes the ground while running, both breasts move downward. Therefore, what is needed is a sports bra that limit breast movement during running activities without relying on the uniform compression of the breasts of the person.

BRIEF DESCRIPTION OF DRAWINGS

The following detailed description of the present disclosure may be better understood, by way of example only, with reference to the following drawings. The elements of the drawings are not necessarily to scale relative to each other, emphasis being placed upon clearly illustrating the principles of the disclosure. Furthermore, like reference numerals designate corresponding features in several views or insets.

DETAILED DESCRIPTION

Figure 1:
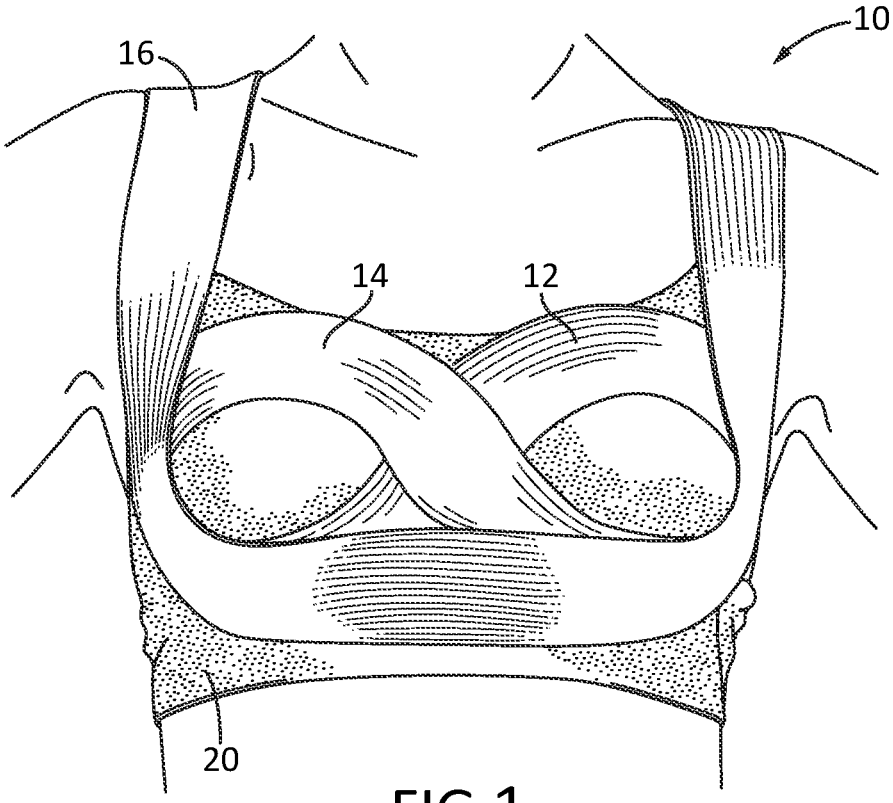
FIG. 1 is a front view showing the band layer of an embodiment of a banded sports bra.

The present disclosure is directed to a sports bra with integrated bands that are positioned to counteract the motion of breasts during both the oblique movement (i.e., one breast moves upward toward the midline of the person and the other breast moves downward laterally away from the midline of the person) and downward movement (i.e., both breasts move downward when the person's foot strikes the ground) periods when a person is running, jumping or bouncing. In a first embodiment, two primary bands can follow symmetrical pathways starting at a person's shoulder, wrapping below the breast nearest the starting shoulder, crossing the midline of the person, wrapping over the breast farthest from the starting shoulder and around the lower rib cage to an endpoint on the back of the person (similar to the path of the lower band of a conventional bra). One primary band begins at the left shoulder of the person, while the other primary band begins at the right shoulder of the person. In addition, a secondary band starts at one shoulder of the person, passes beneath both breasts, and ends at the other shoulder of the person. All bands (i.e., both primary bands and the secondary band) can be adjustable. Primary bands are positioned to counteract the movement of one breast by use of tension provided from the movement of the other breast. For example, when the right breast moves in an oblique direction, the primary bands counteract the movement of the left breast by using the tension created in the primary bands from the right breast's movement. The ability to counteract breast movement enables the primary bands to reduce breast movement during the oblique breast movement phase of running. The secondary band provides resistance to the downward motion of breasts during foot strikes when a person is running. Therefore, the disclosed banded sports bra uses the tension of the bands to limit breast movement during running activities.

The present disclosure is also directed to a banded sports bra for restricting breast movement during rapid movement or running, jumping or bouncing activities of a person. The banded sports bra includes a left primary band that follows a left pathway starting from the left shoulder, under the left breast, over the right breast, and around the lower right rib cage to a left endpoint on the back of the person. Additionally, the banded sports bra has a right primary band that follows a right pathway starting from the right shoulder, under the right breast, over the left breast, and around the lower left rib cage to a right endpoint on the back of the person. A secondary band of the banded sports bra follows a front pathway from the left shoulder, under the left and right breasts, and up to the right shoulder. The right and left primary bands reduce oblique breast movement of the person and the secondary band reduces downward breast movement of the person while the person is moving rapidly or running. In addition, the left primary band includes a left primary band adjustment region at the back of the person, so that the tension of the left primary band is adjustable using a first tension adjustment strap at a left primary band adjustment region. Similarly, the right primary band includes a right primary band adjustment region at the back of the person, so that the tension of the right primary band is adjustable using a second tension adjustment strap at a right primary band adjustment region. Further, the secondary band includes a third and fourth tension adjustment straps at the right and left shoulders of the person, so that the tension of the secondary band is adjustable using either one or both of the third and fourth tension adjustment straps.

The present disclosure is further directed to a banded sports bra for supporting breasts during exercise or other rapid movement of a person. The banded sports bra has several band pathways that allow support of the breasts during oblique and downward breast motion during exercise or rapid movement. The banded sports bra can have left and right primary bands that form a rotated "S" shape about the breasts to reduce unwanted movement of the breasts during oblique breast motion phases of exercise. The banded sports bra can also have a secondary band that is provided under the breasts to reduce downward motion of the breasts during foot strikes occurring while exercising. The primary and secondary bands are adjustable to control the tension provided by the bands at tension adjustment regions with adjustment straps, so that a person can adjust the bands to promote comfort and bra effectiveness.

Figure 2:
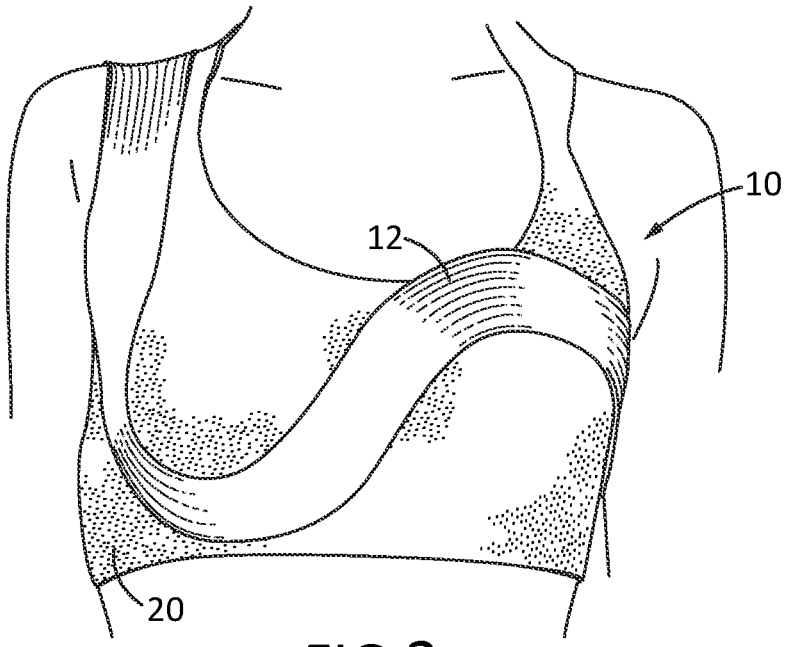
FIG. 2 is a front view showing the right primary band in the band layer of the banded sports bra of FIG. 1.
Figure 3:
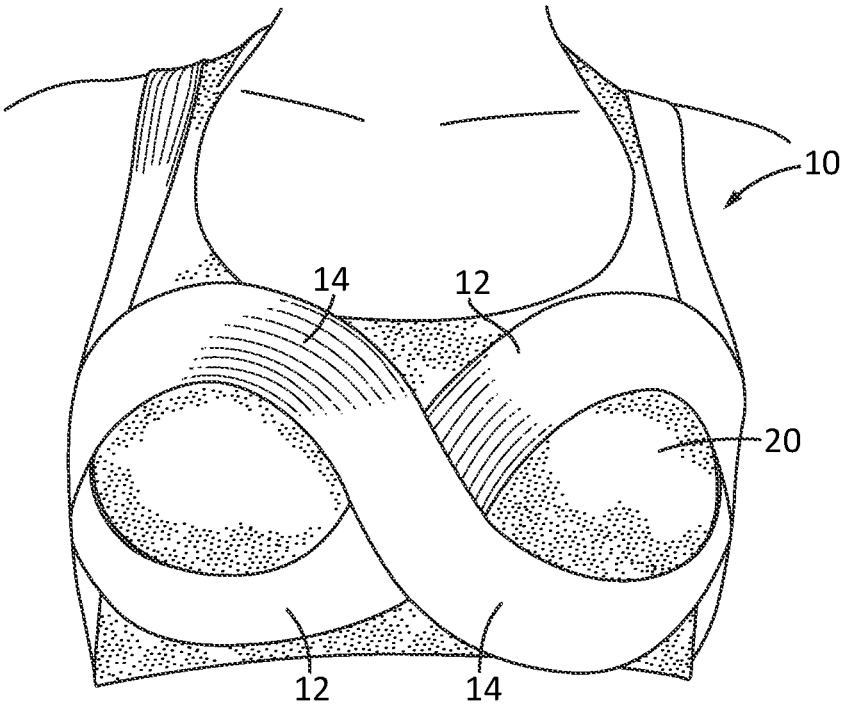
FIG. 3 is a front view showing both primary bands in the band layer of the banded sports bra of FIG. 1.

FIGS. 1-3 show a first embodiment of the band layer of the banded sports bra. As shown in FIG. 1, the banded sports bra 10 can include a base layer 20 with three bands on the base layer 20 that have corresponding pathways that promote reduced breast motion during running or other exercise. As shown in detail in FIG. 2, a right primary band 12 follows a pathway that begins at the right shoulder of the person, travels below the right breast, crosses the sternum, travels above the left breast, follows the lower left rib cage of the person at the lower end of sports bra 10, and finishes at a right endpoint on the person's back (not shown in FIG. 2). Similarly, as seen in FIG. 3, a left primary band 14 follows a pathway that begins at the left shoulder of the person, travels below the left breast, crosses the sternum, travels above the right breast, follows the lower right rib cage of the person at the lower end of the sports bra 10, and finishes at a left endpoint on the person's back. While right primary band 12 is shown below left primary band 14 in FIG. 3, the left primary band 14 can be below the right primary band 12 in other embodiments.

Figure 8:
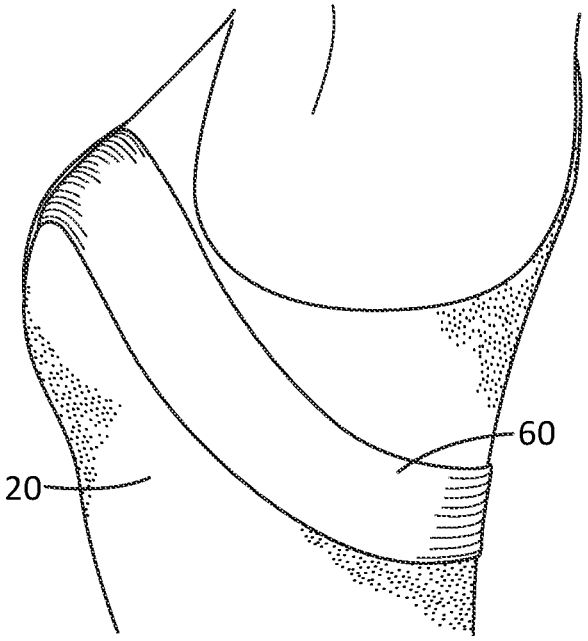
FIG. 8 is a side view showing the one primary band of FIG. 7.

Both primary bands 12, 14 each have a rotated "S" shaped path about the breasts, which taken together form a "FIG. 8" about the breasts to reduce oblique breast motion. The increased tension placed on the primary bands 12, 14 by the movement of one breast during oblique motion is used to counteract the motion of the other breast. Primary bands 12, 14 are each continuous between the origin point on the shoulder and the end point on the back. In addition, primary bands 12, 14 can be any suitable elastic material that has flexible, elastic properties while providing an appropriate level of strength necessary to support the breasts during motion activities. Each primary band 12, 14, is of unitary construction and has a length and width that varies based on the size required for the sports bra 10 to accommodate the person wearing the sports bra 10. In some embodiments, primary bands 12, 14 can be sewn onto the base layer 20 of the sports bra 10, passed through channels formed between the base layer 20 and a cover layer (not shown) of the sports bra 10 in other embodiments, and in yet other embodiment, the primary bands 12, 14 are attached or applied to the exterior of sports bra 10 (either the cover layer or an embodiment that does not utilize a cover layer).

Referring back to FIG. 1, a secondary band 16 has a pathway passing from a first shoulder of the person, beneath both breasts, and ending at the second shoulder of the person. The secondary band 16 is elastic and continuous, so that movement of the breasts in any direction can create tension in the secondary band that reduces the movement of the breasts. Thus, the forceful downward motion of the breasts at each foot strike during running creates tension in secondary band 16, which tension in the secondary band 16 subsequently reduces further breast movement. Secondary band 16 can be any suitable elastic material that has flexible, elastic properties while providing an appropriate level of strength necessary to support the breasts during motion activities. Secondary band 16 is of unitary construction and has a length and width that varies based on the size required for the sports bra 10 to accommodate the person wearing the sports bra 10. In some embodiments, secondary band 16 can be sewn onto the base layer 20 of the sports bra 10 (or one or both of the primary bands 12, 14), passed through channels formed between the base layer 20 and a cover layer (not shown) of the sports bra 10 in other embodiments, and in yet other embodiments, the secondary band 16 can be attached or applied to the exterior of sports bra 10 (either the cover layer or an embodiment that does not utilize a cover layer).

In an embodiment, the starting and ending regions of the secondary band 16 can be adjustable so that the person is comfortable and tension is appropriate to limit or reduce tension of the breasts. The ends (i.e., the starting and ending regions) of the secondary band 16 can incorporate a tension adjustment mechanism to adjust the tension of the secondary band 16. The tension adjustment mechanism can be threaded straps or can be fixed into position by a reversible adjusting mechanisms (i.e., the adjustment can be changed) such as lock and hoop fastenings, button and hole fastenings, clasp and loop fastenings, snaps, or other suitable fastening and adjusting mechanisms. While tension adjustment straps are incorporated into both ends of the secondary band 16 to permit adjustment at both ends of the secondary band 16, the secondary band 16 may only have one tension adjustment strap at one end of the secondary band to permit adjustment only that end of the secondary band 16.

Figure 4:
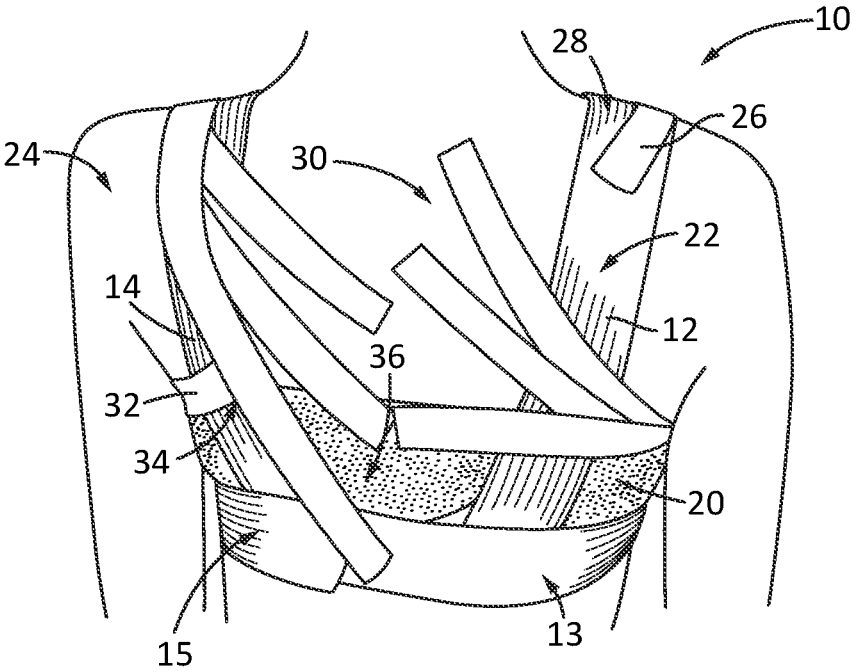
FIG. 4 is a rear view showing the band layer of another embodiment of the banded sports bra.

The embodiment of the sports bra 10 shown in FIG. 4 has some similarities to the embodiment of FIGS. 1-3. However, in FIG. 4, the origin point of each of the primary bands 12, 14 extend down the back of the person to the ending point of the other primary band 12, 14. In FIG. 4, the primary bands 12, 14 can incorporate right and left adjustment regions on the back side of the person. One or both of the ends (i.e., the starting and ending regions) of the primary bands 12, 14 can incorporate a tension adjustment mechanism to adjust the tension of the corresponding primary band. Right primary band 12 can be adjustable using a tension adjustment mechanism located at the origin 13 of the primary band 12, while left primary band 14 can be adjustable using a tension adjustment mechanism located at the origin 15 of the primary band 14. The tension adjustment mechanisms can be threaded straps or can be fixed into position by reversible adjusting mechanisms (i.e., the adjustment can be changed) such as lock and hoop fastenings, button and hole fastenings, clasp and loop fastenings, snaps, or other suitable fastening and adjusting mechanisms. Sports bra 10 is configured to be adjusted by one or both of tension adjustment mechanisms.

In addition, as shown in FIG. 4, the sports bra 10 can also incorporate posture correcting bands for the person. A first posture correcting band configuration 22 can be for anterior rotation of the shoulder and rib cage (i.e., rotation of the shoulder and rib cage forward or toward the front of the body) and a second posture correcting band configuration 24 can be for posterior rotation of the shoulder (i.e., rotation of the shoulder and rib cage backwards or toward the back of the body). The first posture correcting band configuration 22 has a band 26 that can start at the top of the shoulder at origin point 28, come around the rib cage and expand into multiple bands or finger portions 30 that spread out and extend upward toward the origin point 28 and the midline of the back. The tension caused by the finger portions 30 can pull the shoulder and rib cage forward. For example, the first posture correcting band configuration 22 can be used to correct the posture of a person who has forward shoulder rounding by strengthening the muscles of the back (due to resisting the forward pull of the first posture correcting mechanism 22) to counteract the forward rounding of the shoulder.

The second posture correcting band configuration 24 has band 32 that can start midway down the back at origin point 34, go around the rib cage, come off the top of the shoulder and expand into finger portions 36 that spread out and extend downward toward the origin point 34 and the midline of the back. The tension caused by the finger portions 36 can pull the shoulder and rib cage backward. For example, the second posture correcting band configuration 24 can be used to correct the posture of a person who has a shoulder that has a backward shoulder rounding by strengthening the muscles of the chest (due to resisting the backward pull of the second posture correcting mechanism 24) to counteract the backward rounding of the shoulder. While the embodiment of FIG. 4 shows the first posture correcting band configuration 22 on the right shoulder and the second posture correcting band configuration 24 on the left shoulder, the location of the posture correcting band configurations 22, 24 can be reversed in other embodiments. In still additional embodiments, the first posture correcting band configuration 22 or the second posture correcting band configuration 24 can included for both shoulders or one just one shoulder.

Figure 5:
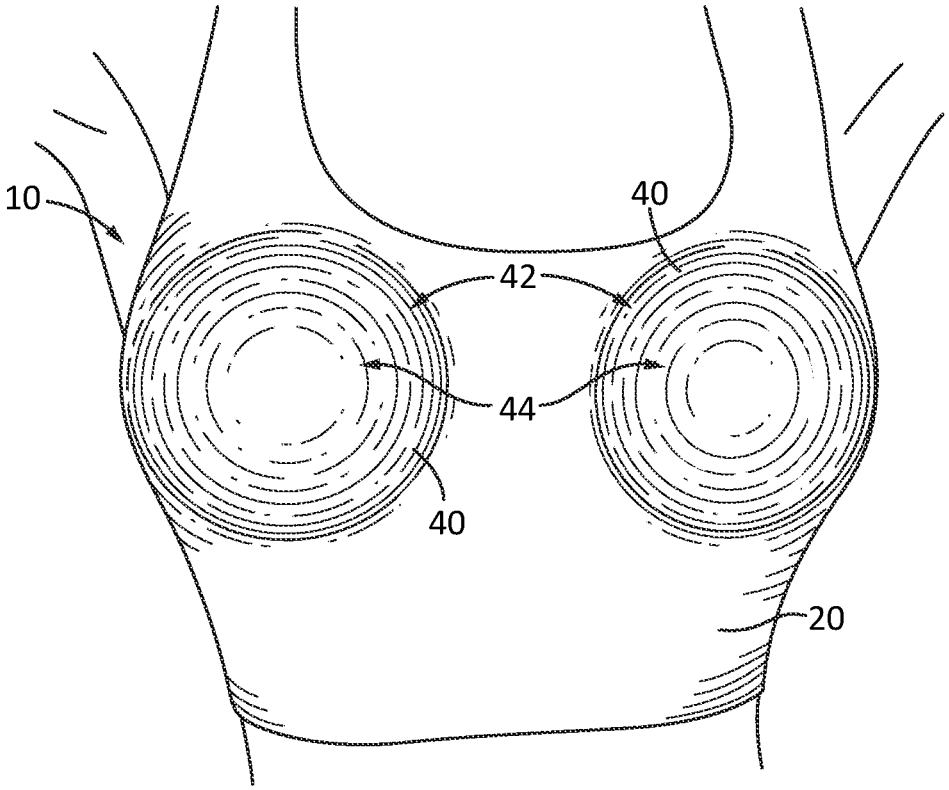
FIG. 5 is a front view showing the base layer of an embodiment of a banded sports bra.
Figure 6:
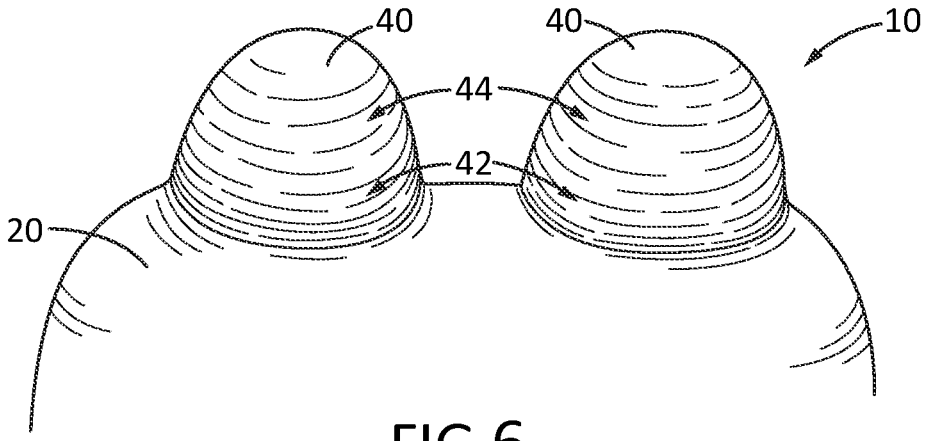
FIG. 6 is a schematic top view showing the base layer of FIG. 5.

Another embodiment of the sports bra is shown in FIGS. 5-18. The sports bra 10 can have a base layer 20 (see FIGS. 5 and 6) that can be made of a stretchy or elastic material (e.g., elastane or spandex) in the general sports bra shape and layout. The base layer 20 can provide a stable platform for bands in the band layer to enable the bands to provide the proper application of tension on or across the body. In order to maintain the proper placement of the bands in the band layer, any cleavage gap (i.e., the space between the sternum and any fabric layer over sternum) has to be minimized or eliminated so the base layer 20 (and any bands passing over the sternum) can fit flush against the sternum. To achieve the removal of the cleavage gap, the base layer 20 can incorporate pockets 40 for the breasts as shown in FIG. 6 that have graduated compression to prevent fluid retention or interruption in flow through the lymphatic channels. The graduated compression of the pockets 40 also help to maintain proper fit and placement of the breast tissue and the sports bra 10. In one embodiment, the pockets 40 can include a first compression region 42 nearer the chest of the person and a second compression region 44 farther from the chest of the person. In one embodiment, the first compression region 42 can be larger (i.e., have a greater volume) than the second compression region 44.

In an embodiment, the band layer of the sports bra 10 can include 3 band types: a primary band type, a secondary band type and a tertiary band type. Each of the band types can be attached to the base layer 20 and made of a stretchy or elastic material (e.g., elastane or spandex) with stretch in only the direction of the band pathway. However, in other embodiments, the band types may stretch in multiple directions depending on the particular design applications or the circumstances of the individual wearing the garment. In a further embodiment, elastic cords 48 (see FIG. 9) can be periodically woven in and out of the corresponding band (see e.g., area 50 in FIG. 9) to maintain the position of the band and prevent entanglement of the cords. The elastic cords 48 may need to be woven in and out of the bands more frequently at turns in the band or around bends (see e.g., area 52 in FIG. 9) in the body to help ensure proper placement and function of the band. The number and size of the elastic cords 48 can vary with the size of the sports bra 10 and the amount of tension needed for different sized breasts and postural position of the individual wearing the sports bra. In an embodiment, the elastic cords 48 can vary in diameter from 0.25 mm to 1.0 mm and vary in number from 8 to 50 elastic cords per band. In other embodiments, elastic cords 48 having a diameter greater than 0.5 mm may require a tunnel or other fastening technique to incorporate the elastic cords 48 into the bands and/or base layer 20.

The position and placement of the bands is based off of the principle that force or tension applied to the body can alter the position and pattern of movement of parts of the body (i.e., force or tension applied to the top of the breast will limit movement of the breast in that direction). As previously described, the movement patterns of the breast during running become elliptical or oblique with rotation of the rib cage though a process called contralateral reciprocation. The contralateral reciprocation movement pattern is limited or controlled by the over/under pathway taken by one or more primary bands of the primary band type. To help control the downward motion of the breasts while running, a secondary band of the secondary band type travels under each breast and back up to the shoulders increasing tension on the underside of the breasts creating lift and limiting the downward movement of the breasts.

Figure 7:
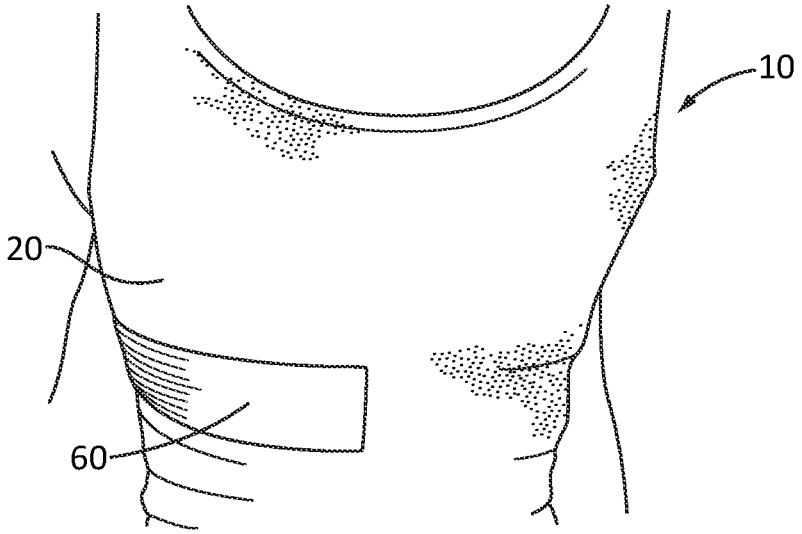
FIG. 7 is a rear view showing an embodiment of one primary band in the band layer of the banded sports bra.
Figure 9:
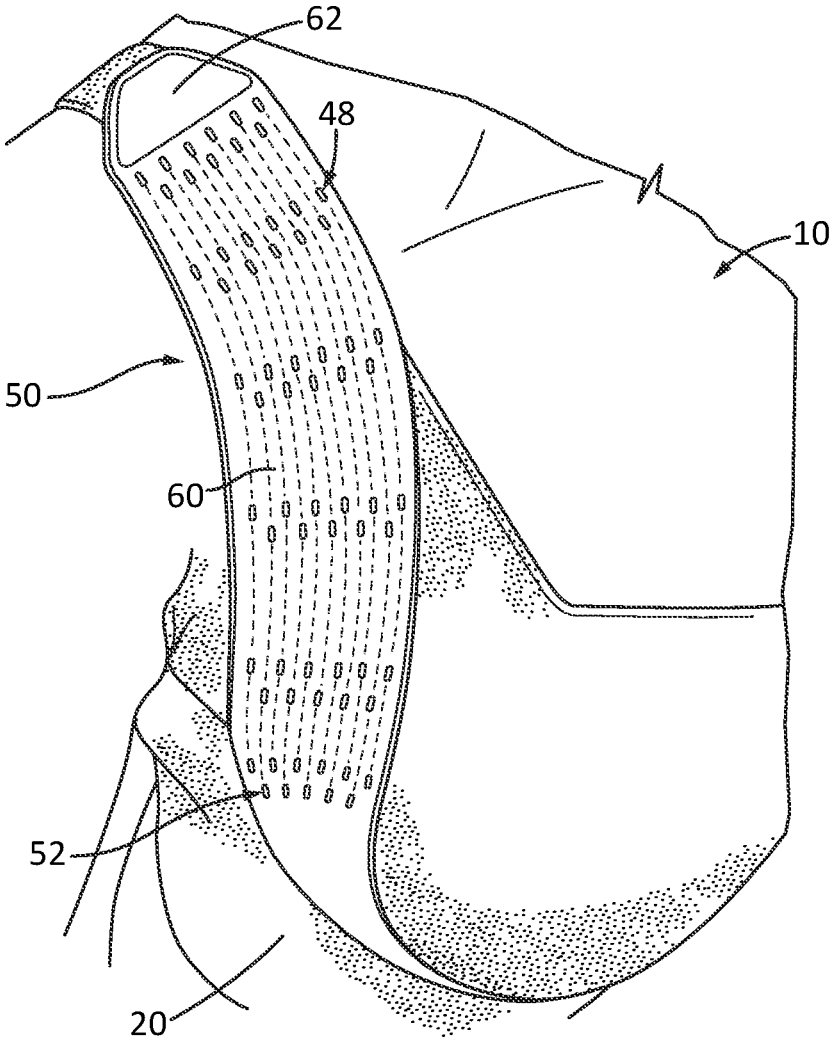
FIG. 9 is a front view showing the one primary band of FIG. 7.

As shown in FIGS. 7-9, a first primary band 60 has a primary pathway that originates at at the midline of the back (see FIG. 7). The band 60 travels around the left side of the rib cage (see FIG. 8), over the left breast (see FIG. 8), across the sternum (while resting on the sternum), under the right breast (see FIG. 9) where the band 60 continues up the chest to the shoulder where then band 60 adjustably attaches at attachment area 62. While not shown in FIGS. 7-9, a second primary band can originate at the midline of the back, travels around the right side of the rib cage over the right breast, across the sternum, under the left breast where it continues up the chest to the shoulder where it adjusts and attaches at a similar attachment area. In an embodiment, the primary bands (e.g., band 60) can be similar to primary bands 12, 14. In an alternate embodiment, the first primary band 60 and the second primary band may be a single continuous band that starts at the midline of the back and have ends that take primary pathways around the breasts as described above for the individual primary bands (e.g., band 60).

Figure 10:
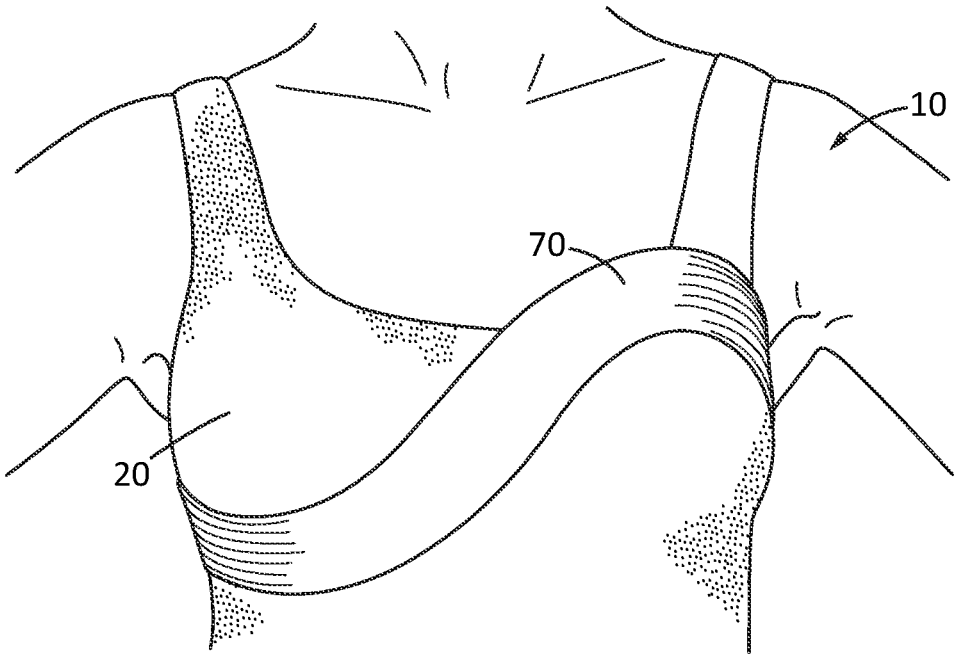
FIG. 10 is a front view showing an embodiment of one primary band in the band layer of the banded sports bra.
Figure 11:
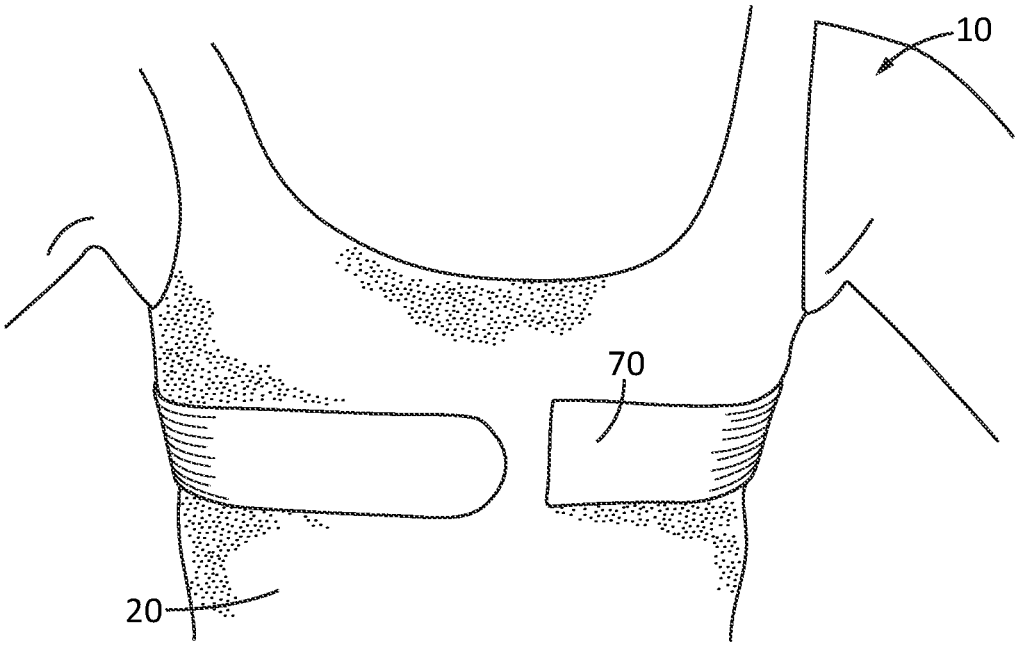
FIG. 11 is a rear view showing the one primary band of FIG. 10.
Figure 12:
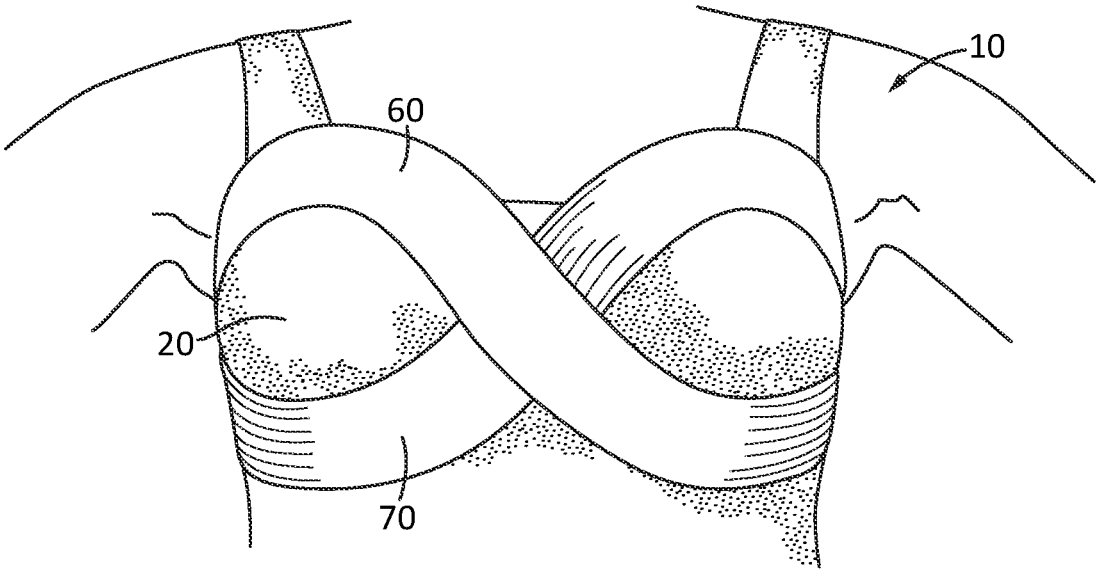
FIG. 12 is a front view showing an embodiment of both primary bands in the band layer of the banded sports bra.

FIGS. 10-12 show an embodiment of an alternate (or secondary) pathway for the primary bands (e.g., band 60). The secondary pathway for the primary bands can be used for individuals with an anterior rotation of the pectoral girdles (i.e., a "slumped over" or shoulders rolled forward position). The secondary pathway for the primary bands can reduce tension on the front side of the shoulders by moving the attachment sites for the primary bands to the midline of the back near the corresponding primary band's origin point. The secondary pathway for second primary band 70 can originate at the midline of the back (see FIG. 11) and travels around the right side of the rib cage under the right breast (see FIG. 10), across the sternum (while resting on the sternum) (see FIG. 10), over the left breast (see FIG. 10) and around the left side of the ribs where the primary band 70 can adjustably attach near the origin site for the secondary pathway for primary band 60. Primary band 60 can have a secondary pathway that originates at the midline of the back and travels around the left side of the rib cage, under the left breast (see FIG. 12), across the sternum (while resting on the sternum) (see FIG. 12), over the right breast (see FIG. 12) around the right side of the rib cage where the primary band 60 can adjustably attach near the origin site for the secondary pathway for band 70. In an alternate embodiment, the first primary band 60 and the second primary band may be a single continuous band that starts at the midline of the back and have ends that take secondary pathways around the breasts as described above for the individual primary bands (e.g., bands 60, 70).

Figure 13:
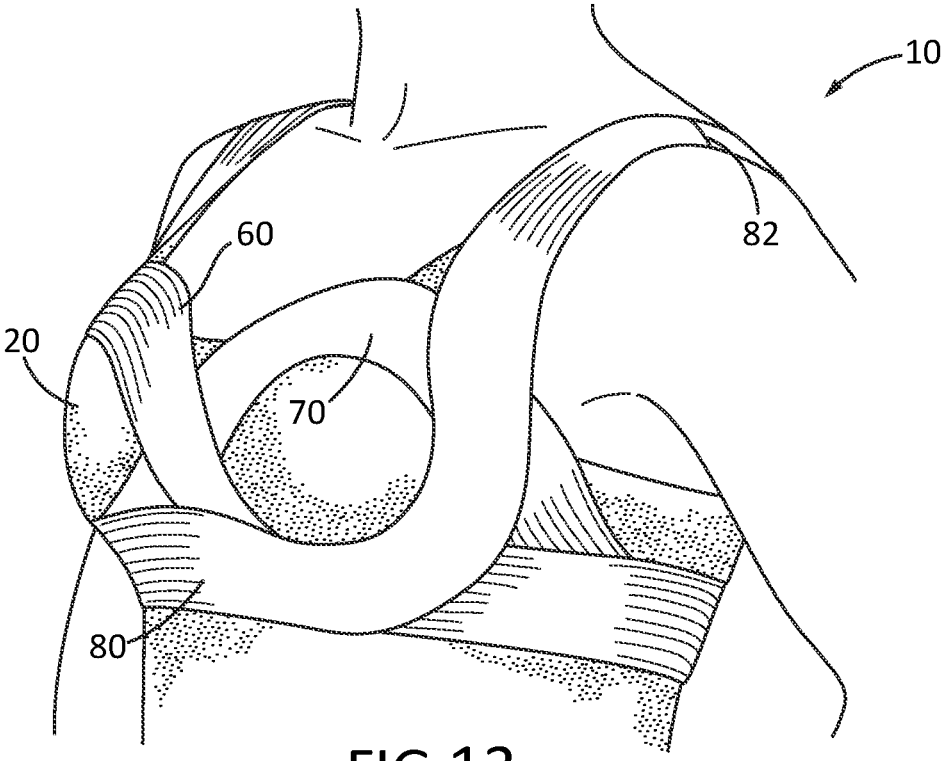
FIG. 13 is a front view showing an embodiment of the secondary band in the band layer of the banded sports bra.

FIG. 13 shows the primary pathway for a band of the secondary type. Secondary band 80 is a single continuous band that originates (or has an origin point) at the band's midpoint at the midline of the sternum with one end of secondary band 80 traveling from the origin point under and around the right breast continuing up the chest to the front of the shoulder where the end of the secondary band adjustably attaches at an attachment area. The other end of secondary band 80 travels under and around the left breast continuing up the chest to the front of the shoulder where the end of the secondary band 80 adjustably attaches at attachment area 82. The primary pathway for secondary band 80 provides additional support and lift to the breasts while helping to reduce and control movement of the breasts during high impact movements like running, jumping or bouncing.

Figure 14:
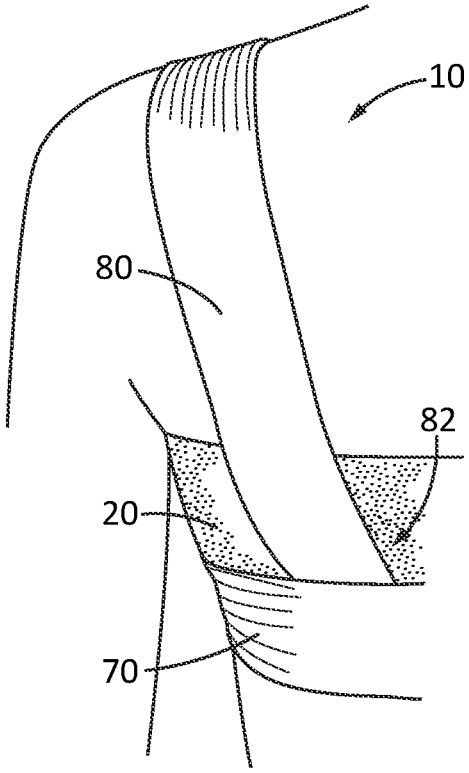
FIG. 14 is a rear view showing another embodiment of the secondary band in the band layer of the banded sports bra.

FIG. 14 shows a secondary pathway for secondary band 80 that helps to reduce tension or pull on the front side of the shoulders by relocating the adjustment/attachment site 82. The use of the secondary path for the secondary band 80 may be used in conjunction with the secondary pathways for primary bands 60, 70 to reduce stress on individuals with a forward slumped or anterior rotation of the pectoral girdles. The secondary pathway for secondary band 80 begins at the band's midpoint at the midline of the sternum and one end travels under and around the right breast continuing up the chest and over the shoulder where the band 80 travels down the back and adjustably attaches at an attachment area above band 60. The secondary pathway for the other end of secondary band 80 begins at the band's midpoint at the midline of the sternum and travels under and around the left breast, continuing up the chest and over the shoulder (as shown in FIG. 13), where the band 80 travels down the back and adjustably attaches at an attachment area 82 above band 70.

Figure 16:
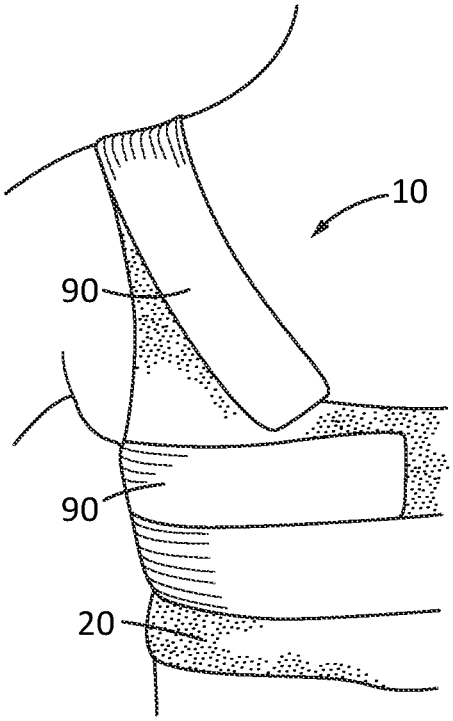
FIG. 16 is a rear view showing the tertiary band of FIG. 15.
Figure 15:
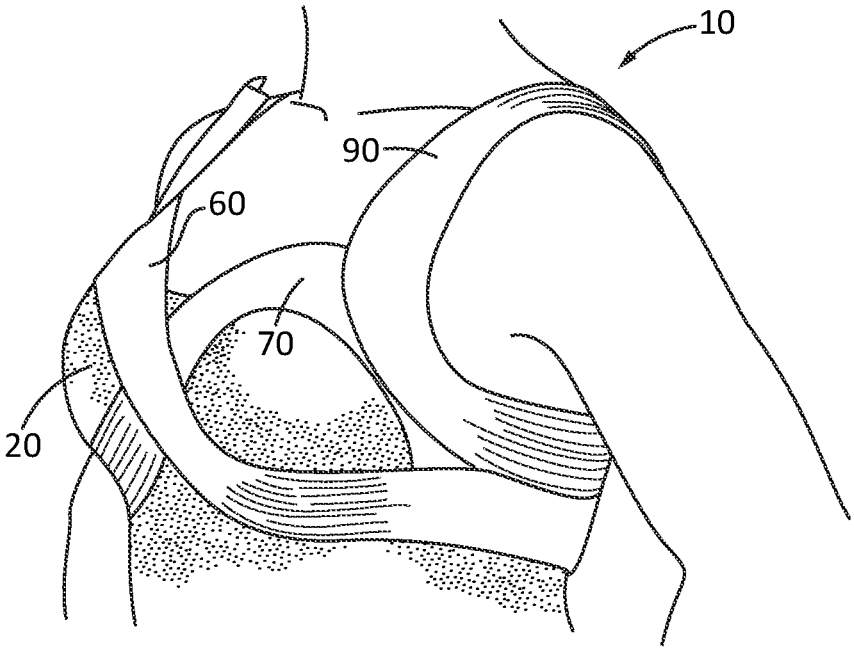
FIG. 15 is a front view showing an embodiment of the tertiary band in the band layer of the banded sports bra.

A tertiary band of the tertiary band type can be used to pull the front of the shoulder backwards to reduce anterior rotation of the pectoral girdles and to counteract the forces placed on the shoulders by the primary pathways for bands 60, 70, 80. As shown in FIGS. 15 and 16, tertiary band 90 can originate at the midline of the back above band 60 and travel around the left side of the rib cage, up the chest near band 70 and over band 80 where the band 90 travels across the back at an oblique angle traveling over the secondary pathway for band 80 (if used) where band 90 adjustably attaches at an attachment point just above the corresponding origin point for band 90. Similarly band 90 may also be used for the right shoulder. When used for the right shoulder, the band 90 can originate at it's midpoint at the midline of the back above band 70 and travel around the right side of the rib cage, up the chest near band 60 and over band 80 where band 90 travels across the back at an oblique angle traveling over the secondary pathway for band 80 (if used) where the band 90 adjustably attaches at an attachment point just above its origin point. In an alternate embodiment, the third band type may have a single continuous band that originates at the band's midpoint at the midline of the back and have ends that take pathways as described above for band 90.

Figure 18:
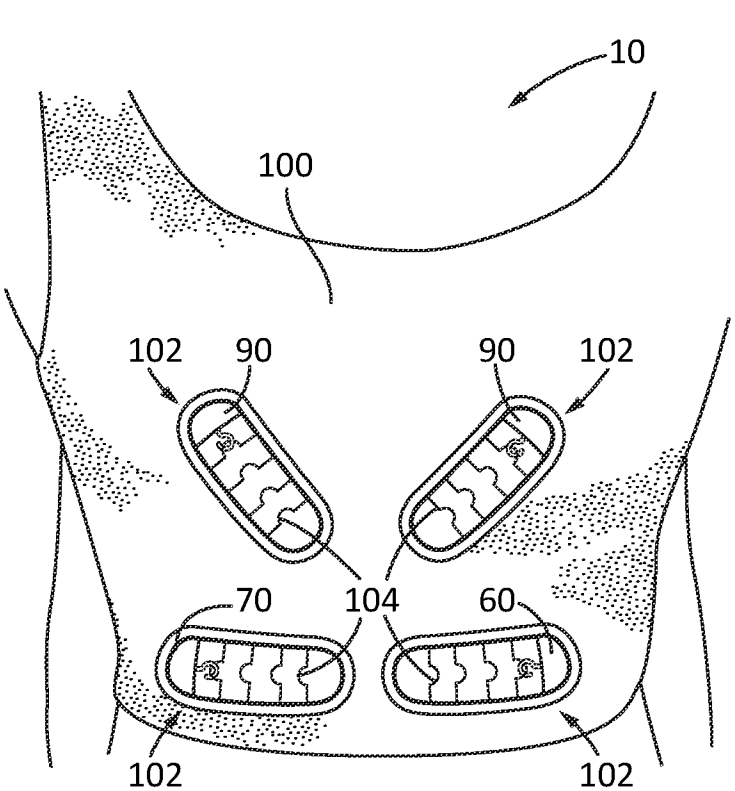
FIG. 18 is a rear view showing embodiments of attachment areas on the cover layer of the banded sports bra.
Figure 17:
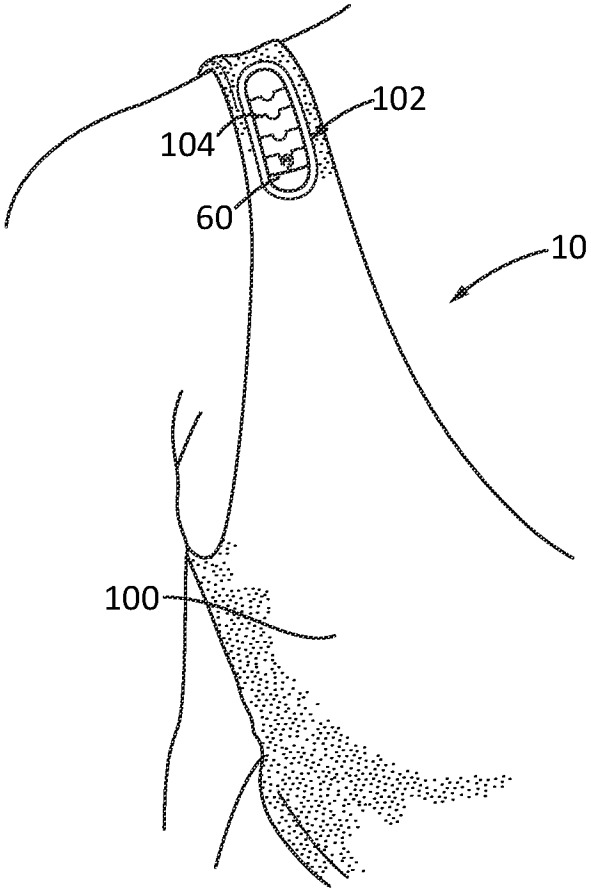
FIG. 17 is a front view showing an embodiment of an attachment area on a strap of the cover layer of the banded sports bra.
Figure 21:
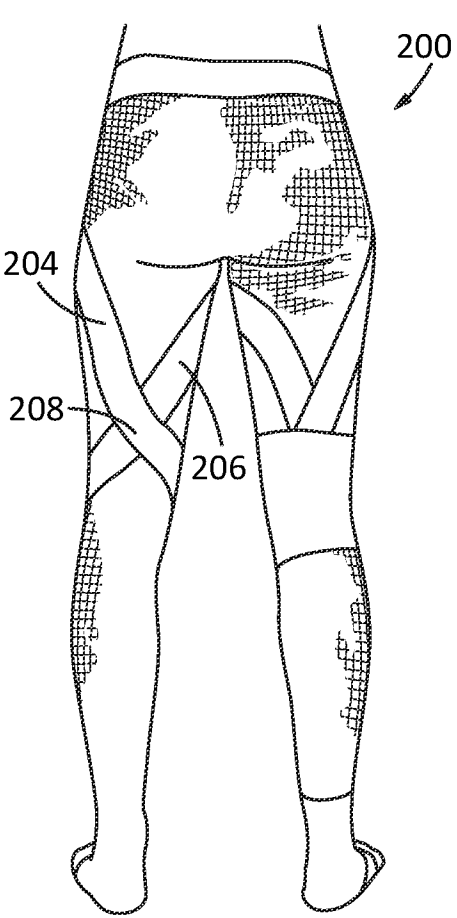
FIG. 21 is a rear view showing the location of the resistance bands of FIG. 19.
Figure 20:
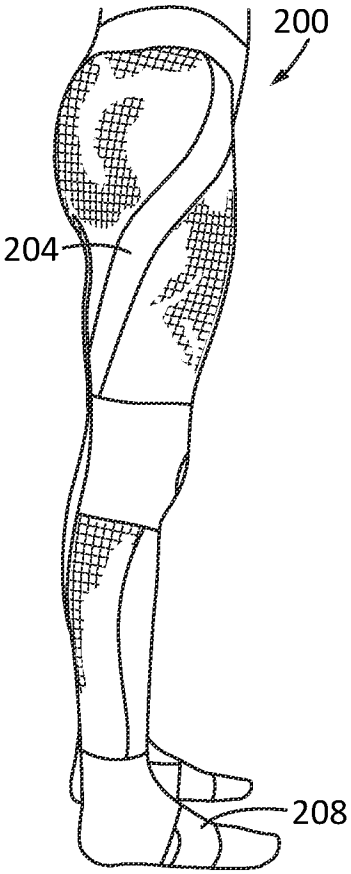
FIG. 20 is a side view showing the location of the resistance bands of FIG. 19.
Figure 19:
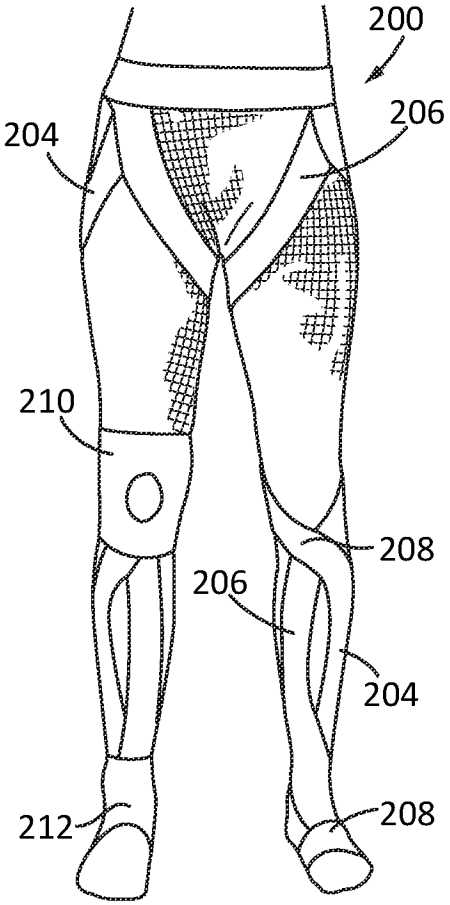
FIG. 19 is a front view showing an embodiment of the location of resistance bands in the band layer of sports pants.
Figure 22:
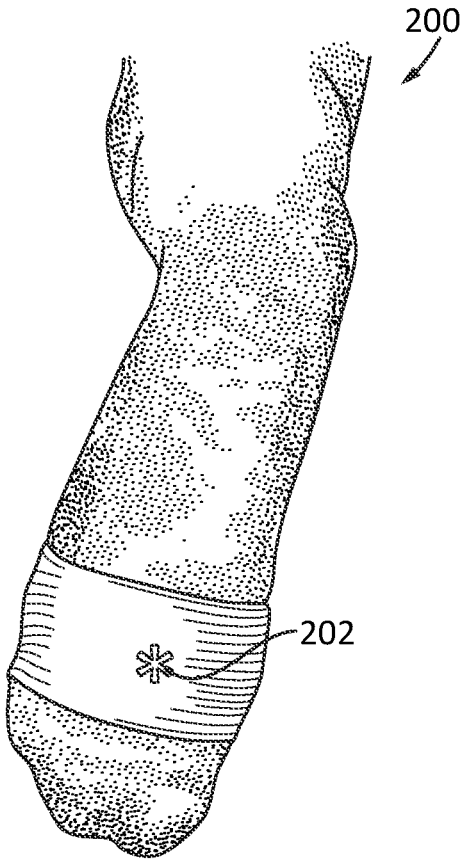
FIG. 22 is a bottom view showing the location of the origin point for the resistance bands of FIG. 19.

A cover layer for the sports bra 10 can be made of a multidirectional stretch fabric (e.g., elastane or spandex) in the general sports bra shape and layout. As seen in FIGS. 17 and 18, the cover layer 100 can provide protection for the bands 60, 70, 80, 90 and any elastic cords 48 that weave in and out of the bands 60, 70, 80, 90. In addition, the cover layer 100 can help to provide structural stability to the sports bra 10 by being sewn or attached to the base layer 20 and/or the bands 60, 70, 80, 90 to maintain tension and pressure on the body along the correct pathways. In addition, the cover layer 100 can have one or more cutout areas 102 that provide access to corresponding attachment mechanisms 104. In one embodiment, the attachment mechanisms 104 can be fastened to the base layer 20 or any corresponding band located at the cutout area 102 and have corresponding mechanisms that permit the corresponding band to be attached and reattached to the attachment mechanism 104 depending on the desired tension for the corresponding band.

In the embodiments shown in FIGS. 17 and 18, the attachment mechanisms 104 can have a series of female connectors (or loops) that are evenly spaced through the attachment mechanism 104. The female connectors can receive corresponding male connectors (or hooks) that located on the end of the corresponding band to be connected to the attachment mechanism 104. Based on the selection of a particular female connection of the attachment mechanism 104 for attachment, the corresponding tension applied to the band can be adjusted (i.e., increased or decreased). FIG. 17 shows the attachment of band 60 to the first female connector of attachment mechanism 104. To increase the tension on the band 60, the band 60 can be attached to other female connectors further up the shoulder. In an alternate embodiment, band 80 could be attached to the attachment mechanism 104 of FIG. 17 in place of or in addition to band 60. FIG. 18 shows the attachment of bands 90 and bands 60 and 70 (when using the secondary pathway) to the corresponding first female connectors of attachment mechanism 104. In one embodiment, the cover layer 100 may incorporate corresponding flaps or cover portions to cover over the cutouts 102 and the attachment mechanisms 104 to provide a smoother exterior surface for the sports bra 10.

In one embodiment, the bands of the sports bra 10 can all have a uniform width (e.g., 2 inches). However, in other embodiments, portions of the bands of the sports bra 10 can be expanded to have larger widths than other portions of the sports bra 10. For example, bands 60, 70 and 80 may have larger widths in those areas that pass or travel above and/or below the breasts in order to obtain additional tension and support for limiting movement of the breasts. Additional tension and support may be needed for a person with larger breasts to accommodate the additional volume and mass from the larger breasts.

In another embodiment as shown in FIGS. 19-23, elastic bands similar to the bands 60, 70, 80, 90 used for the sports bra 10 can be incorporated into sports pants worn by a person to provide strength training for the person. The bands are positioned in a band layer of the sports pants between a base layer and a cover layer to provide resistance to the person's movements thereby increasing the strength of the person.

As shown in FIGS. 19-22, the sports pants 200 can include a continuous resistance band (for each leg) having two portions that extend from an origin point 202. The band portions 204, 206 cross the ankle, knee and hip joints in a manner designed to resist the primary muscles used in running. The resistance from band portions 204, 206 forces the individual to carry his or her body weight as well as work against the elastic bands, effectively allowing the runner to train harder in less time while increasing strength without altering the runner's gait or stride.

The band portions 204, 206 (one set for each leg) can originate from the origin point 202 (see FIG. 22) at the midpoint of the band on the bottom of the foot. The band portions 204, 206 start at the plantar surface of the feet at the tarsal-metatarsal joints. The band portions 204, 206 can then wrap around the foot to the dorsal surface of the foot where the band portions 204, 206 overlap creating an anchor point 208 (see FIG. 19) before continuing up the anterior surface of the shin (or front of the leg), overlapping again just below the knee to form another anchor point 208. The band portions 204, 206 in the lower leg portion can resist plantar flexion of the foot and ankle by the gastrocnemius and soleus thereby increasing workload for the calf muscles (or calves) during a running motion.

Figure 23:
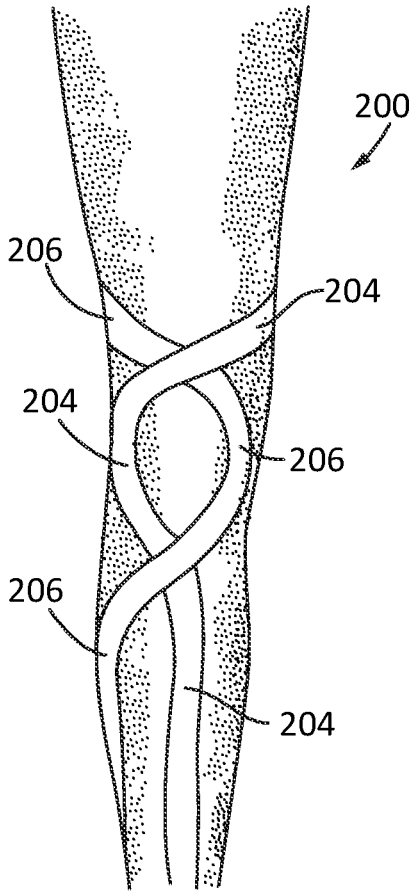
FIG. 23 is a front view showing an alternate embodiment of the location of resistance bands in the band layer of sports pants.

The band portions 204, 206 pass around the side of the knee to the back of the leg where they overlap again creating an anchor point 208 (see FIG. 21) before continuing up the hamstring muscles (or hamstrings), around the side of the leg (see FIG. 20) to the front of the leg passing up the hip flexors to the anterior superior iliac spine (ASIS). In an alternate embodiment as shown in FIG. 23, the band portions 204, 206 can circle the knee and cross over again above the knee before continuing to the hamstrings (as described above) to provide additional support for the knee. The band portions 204, 206 in the upper leg portion resist concentric contraction of the quadriceps muscles (or quads) and gluteal muscles (or glutes) increasing the workload for the muscles during a running motion. Specifically, when the band portions 204, 206 pass along the hamstrings, the band portions 204, 206 resist the concentric contraction of the quads and when the band portions 204, 206 pass along the side of the leg and up the front of the leg over the hip flexors, the band portions 204, 206 resist the concentric contraction of the glutes. As the band portions 204, 206 pass from the anterior shin and knee up to the posterior thigh and then around the hip to the ASIS, the band portions 204, 206 place additional elastic load on the quadriceps and gluteal muscles.

The band portions 204, 206 end after being wrapped from one leg to the opposing hip (e.g., band portions 204, 206 on the right leg go around the waist to the left hip) along the waistband where the tension can be adjusted by tightening or loosening the band portions 204, 206 at the belt line. In an embodiment, an additional fabric layer 210 can be used to help stabilize the movement of the knee and to secure the bands in place. In a further embodiment, another additional fabric layer 212 can be used to stabilize the movement of the ankle and help secure the bands along the proper pathway.

In a further embodiment as shown in FIGS. 24-32, elastic bands similar to the bands 60, 70, 80, 90 used for the sports bra 10 can be incorporated into sports pants worn by a person to provide a performance boost for the person. The bands are positioned in a band layer between a base layer and a cover layer of the sports pants to supplement the person's movements thereby reducing the energy required by the person.

As shown in FIGS. 24-32, the sports pants 300 can include 6 elastic band pathways. The elastic band pathways can be specifically placed so as each joint bends through an eccentric motion of flexion, the corresponding bands build a returnable force through the stretching (or tensioning) of the elastic bands placed along the pathways. In one embodiment, the sports pants 300 can include 3 primary gluteal bands, 1 optional gluteal band that builds stretch or tension as the hip bends or flexes and two primary leg bands. The stored energy of the bands can be applied as a force on the extension motion through the concentric contraction.

Figure 26:
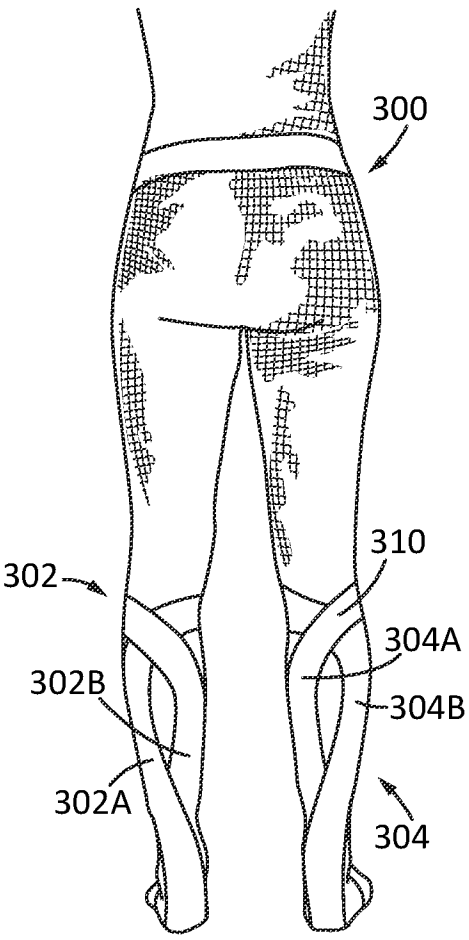
FIG. 26 is a rear view showing the location of performance bands of FIG. 24.
Figure 25:
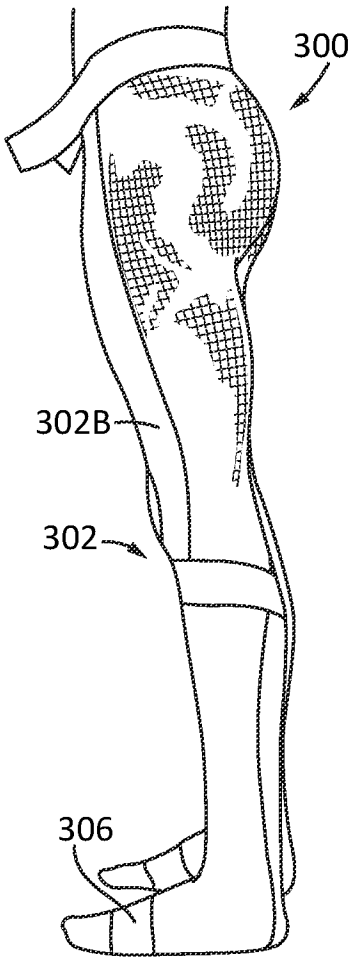
FIG. 25 is a side view showing the location of performance bands of FIG. 24.
Figure 24:
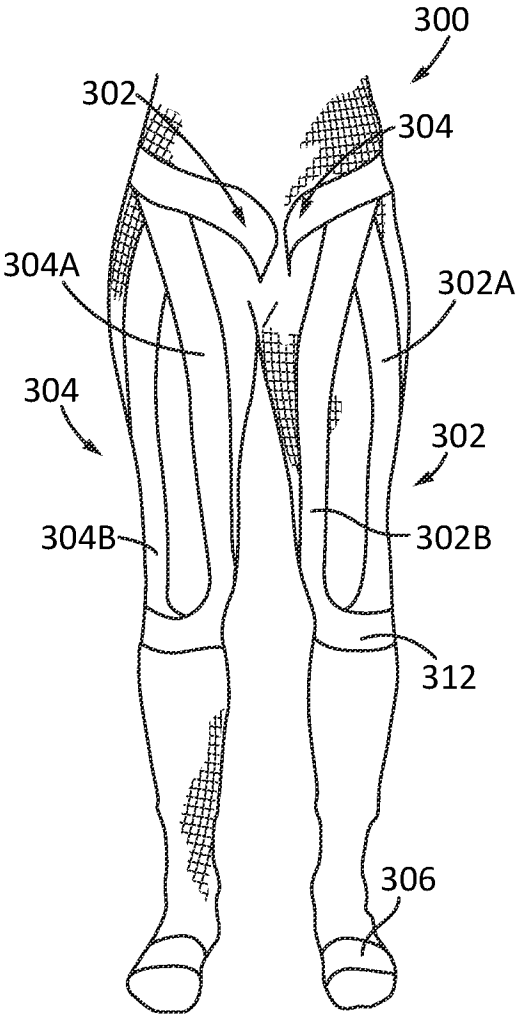
FIG. 24 is a front view showing an embodiment of the location of performance bands in the band layer of sports pants.
Figure 29:
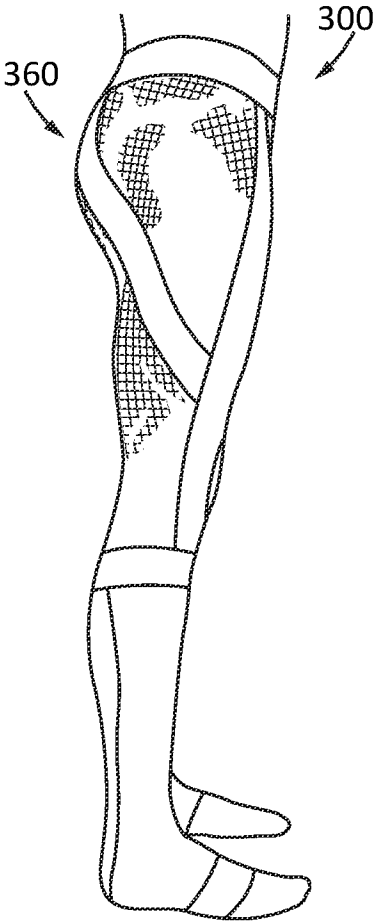
FIG. 29 is a side view showing the location of the performance bands of FIG. 27.
Figure 28:
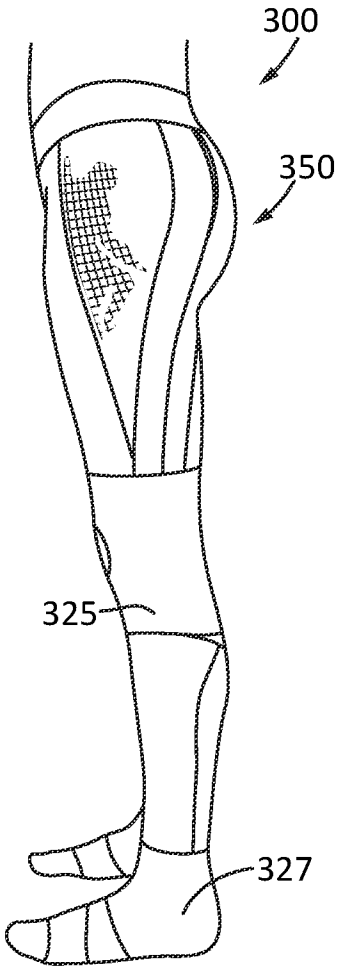
FIG. 28 is a side view showing the location of the performance bands of FIG. 27.

As shown in FIGS. 24-26, there are two primary leg bands, a left band 302 (having a first portion 302A and a second portion 302B) and a right band 304 (having a first portion 304A and a second portion 304B) each of which is continuous and extends from an origin point 306 (i.e., the midpoint of the corresponding band 302, 304) on the top of the foot. The portions of the corresponding band go around opposite sides of the corresponding foot where the portions crossover each other at the distal portion of the metatarsal creating an anchor point 308 (see FIG. 31). The bands 302, 304 then pass along the bottom of the corresponding foot, around the heel and up the back of the leg. The portions of the bands then separate and go around the calf and then cross over each other again creating an anchor point 310 (see FIG. 26) before passing around the front of the knee. As the ankle flexes, the elastic bands 302, 304 can be stretched during the eccentric contraction of the ankle, storing energy to be released as force during the concentric contraction of the ankle.

As the portions pass underneath the knee cap, the portions cross over each other again creating another anchor point 312 (see FIG. 24). The portions then separate and pass up the front of the quads to the ASIS where the portions come together or are stacked and track around the waistband to the opposite hip where they can be adjusted at an adjustment area for the proper tension (e.g., pulling the band 302 from the right hip can tighten the bands of the left leg). The pulling of a corresponding band allows each leg tension levels to be adjusted independently to correct strength imbalances in an embodiment.

Figure 32:
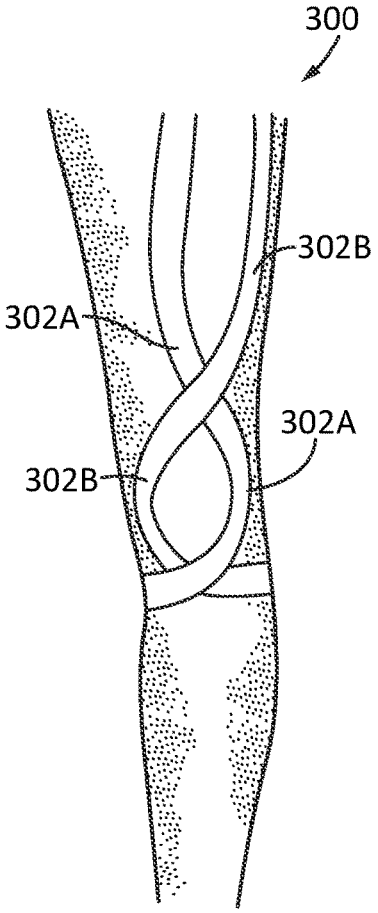
FIG. 32 is a front view showing an alternate embodiment of the location of performance bands in the band layer of sports pants.

The stretch (or tension) of the bands 302, 304 between the hip and anchor point 312 below the knee is increased by tightening the waistband end of the bands 302, 304. As the bands 302, 304 pass up the quad to the waist band, the bands 302, 304 are stretched by bending the knee which increases force during the concentric contraction. In an alternate embodiment as shown in FIG. 32, the band portions 302A, 302B can circle the knee and cross over again above the knee before passing up the front of the quads (as described above) to provide additional support for the knee. Because the bands 302, 304 are continuous, the bands 302, 304 can build tension or stretch to an increasing degree as each joint bends. Because the anchor points 308, 310, 312 can restrict band movement to some degree through friction, the bands 302, 304 can also have tension that builds between anchor points 308, 310, 312. In an embodiment, the placement of the bands 302, 304 along each pathway can be maintained by having the bands 302, 304 weave in and out of the base fabric layer along the pathways and/or be held in place by channels created by an additional fabric layer as the bands bend and turn at the joints and at anchor points. In another embodiment, additional separate bands can be placed between anchor points 308, 310, 312 to increase stretch resistance to specific regions of the continuous pathway of the bands 302, 304. The additional bands can be added to increase stretch resistance for strength imbalances or for specific activities which require more stretch or tension in specific movements. An anchor point can be created where both sections of the additional bands cross over each other.

Figure 27:
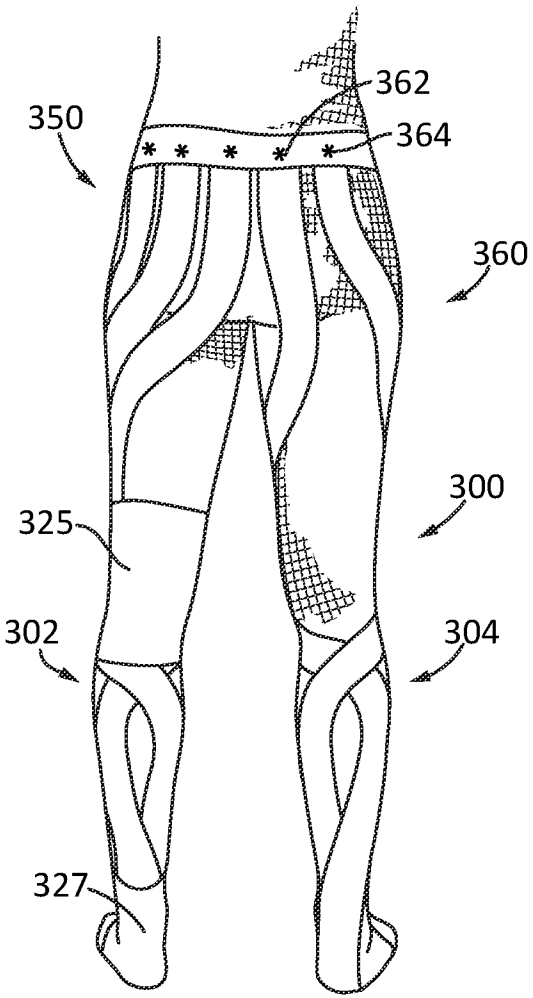
FIG. 27 is a rear view showing another embodiment of the location of performance bands in the band layer of sports pants.
Figure 30:
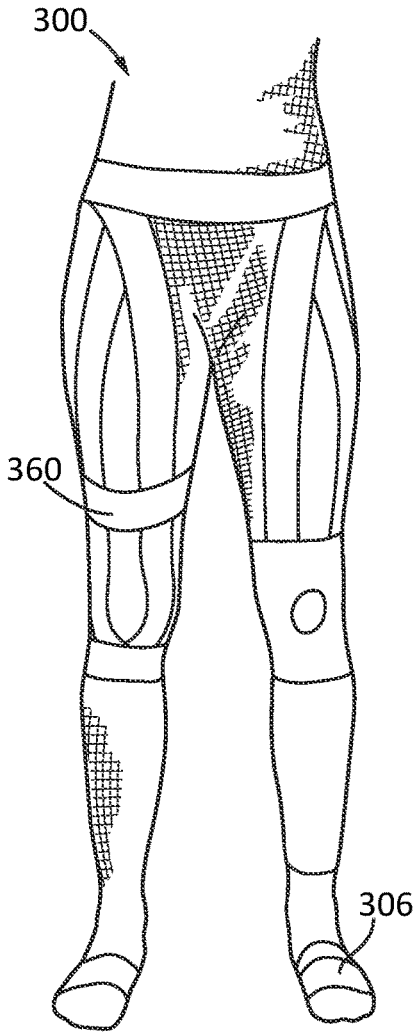
FIG. 30 is a front view showing a further embodiment of the location of performance bands in the band layer of sports pants.
Figure 31:
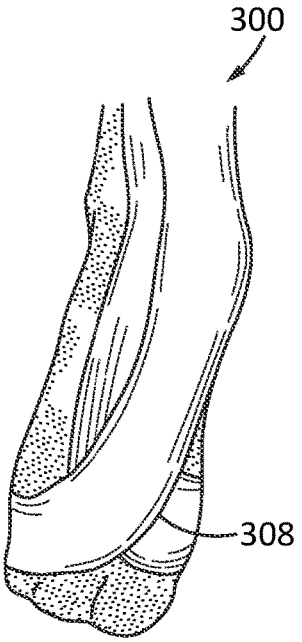
FIG. 31 is a bottom view showing the location of a connection point for the performance bands of FIG. 24.

FIGS. 27-30 show an alternate embodiment of the sports pants 300 that incorporate gluteal bands. As shown in FIG. 27, the sports pants 300 may include primary gluteal bands 350 and a secondary gluteal band 360. Primary gluteal bands 350 can be elastic bands that can be stretched as the hip bends, adding spring and force to the running motion as the hip joint extends to help propel the runner forward. The primary gluteal bands 350 are not continuous with bands 302, 304. The primary gluteal bands 350 can span from the waistband to the lateral portion of the knee. As the hip joint bends, the primary gluteal bands 350 produce added force to the concentric contraction of the gluteus maximus muscle as the hip straightens or extends.

The secondary gluteal band 360 can be used in one embodiment dependent on the hip flexor strength of the runner. The secondary gluteal bands 360 can be continuous and originate at the sacral base at point 362, extend down the gluteus medius muscle (or medial glute) and upper hamstring traveling around the front of the leg at mid-thigh (see FIG. 30), up the lateral hamstring and glutes to attach to the waistband at asterisk mark 364. In one embodiment, the secondary gluteal band 360 can be used to correct movement patterns relating to gait or stride or postural basis. In an embodiment, an additional layer of fabric 325 can be used to compress the knee joint, adding space in the joint capsule, as well as serving as an anchor point that can help stabilize the band portions 302A, 302B (and possibly bands 350) as the bands pass over or near the knee joint. In another embodiment, an additional layer of fabric 327 can be used to compress the ankle joint, adding space in the joint capsule, as well as serving as an anchor point that can help stabilize the bands 302A, 302B as they pass over the ankle joint.

In an embodiment, as the band portions pass over each joint, the band portions are anchored to both add stability as well as appropriately apply the force from the tensioned band to areas above and below the joint. Since the bands are continuous and have anchor points at each joint; as each joint of the leg bends, the bands are stretched creating a load force to be redirected during concentric muscle contraction. In another embodiment, the bands 302, 304 from the quads can trace up around the super iliac crest to the waist band and join superior to (or above) the sacrum. As each joint in the leg bends, the joint stretches the bands 302, 304 that span over each joint. In one embodiment, as the hip bends, the primary gluteal bands 350 traveling from the sacrum across the glutes and down the IT (iliotibial) band are stretched and store energy. As the knee bends, the energy traveling along the bands 302, 304 from the ASIS across the knee joint (below the patella) to the calf is stretched. As the ankle bends, the bands 302, 304 that travel from the plantar surface of the foot across the ankle over the calcaneus and up the calf is stretched. The bands 302, 304 passing from the plantar surface of the foot up the leg to the ASIS are continuous bands that increase the energy stored by the stretch of the bands 302, 304 when both/all joints of the leg flex as in a running motion. To maintain continuity of the bands 302, 304, the path should follow a line traveling from the plantar surface of the foot in a lateral to medial and medial to lateral pattern (e.g., from lateral calf to medial quad crossing under the patella and medial calf to lateral quad passing under the patella). Velcro attachments on the bands 302, 304 may be used to increase/decrease tension on band. In one embodiment, the bands 302, 304, 350 and 360 can be located or sewn into a band layer that is between a base layer and a cover layer similar to the sports bra 10. In one embodiment, channels can be formed that follow specific lines between joints to guide the movement and to direct the energy created by stretching the bands 302, 304 as each joint bends. The cover layer of the sports pants 300 can be sewn to the base layer of the of the sports pants to create tunnels for the moving/stretching of the bands thereby directing the force of the stretch in opposition to the bend of the joint.

In other embodiments, the pathways of the bands 302, 304 passing inferior to the patella combined with the crisscross pattern focuses the bands 302, 304 to act as an anchor/pivot point. The anchor point allows the continuous bands 302, 304 to be compoundly stretched by both knee flexion and dorsal flexion of the ankle. Primary gluteal bands 350 from the sacrum across the glutes to the IT band add spring. Bands 302, 304 from the quads can cross up and over the iliac crest where the bands 302, 304 connect at the midline above the sacrum in the waistband. The crisscrossing of the bands 302, 304 allows for customization of tension to help balance the dynamic movement between the ankle and knee to help restore proper patella tracking.

Figure 33:
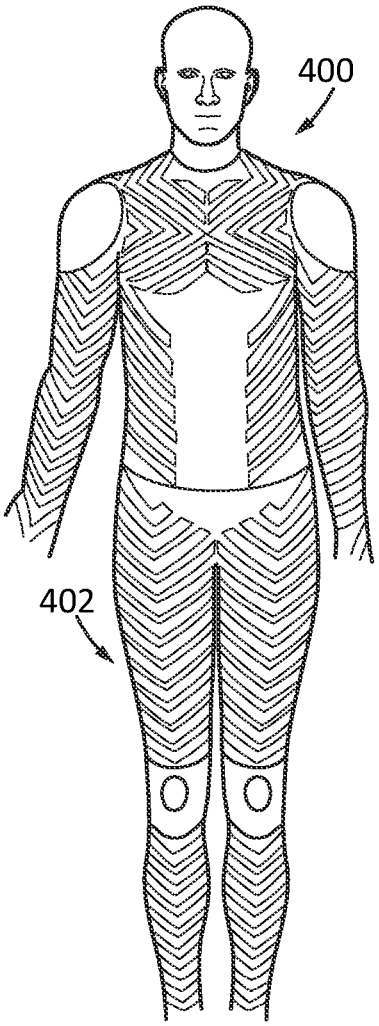
FIG. 33 is a front view showing an embodiment of the location of lymphatic bands in sports clothing.
Figure 34:
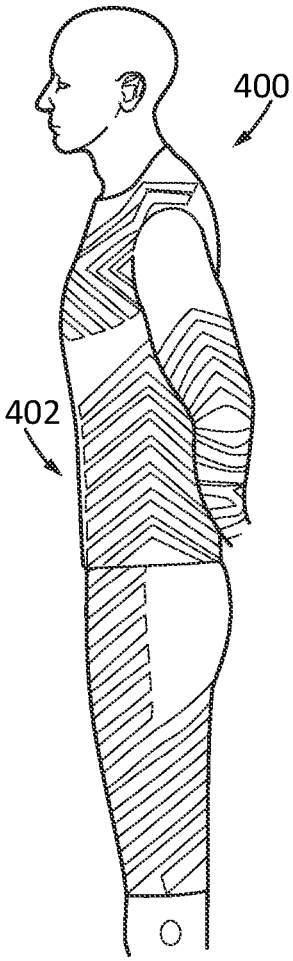
FIG. 34 is a side view showing the location of the lymphatic bands in the sports clothing of FIG. 33.
Figure 35:
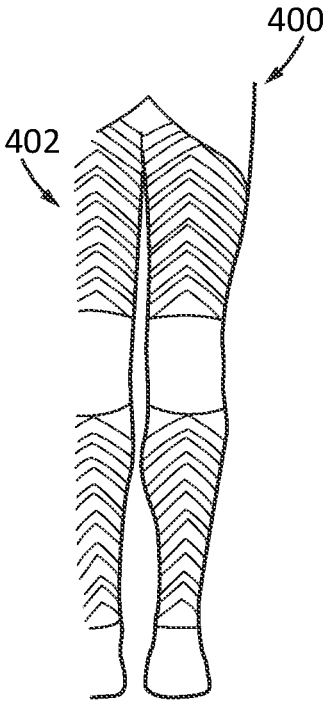
FIG. 35 is a rear view showing the location of the lymphatic bands in the sports clothing of FIG. 33.
Figure 36:
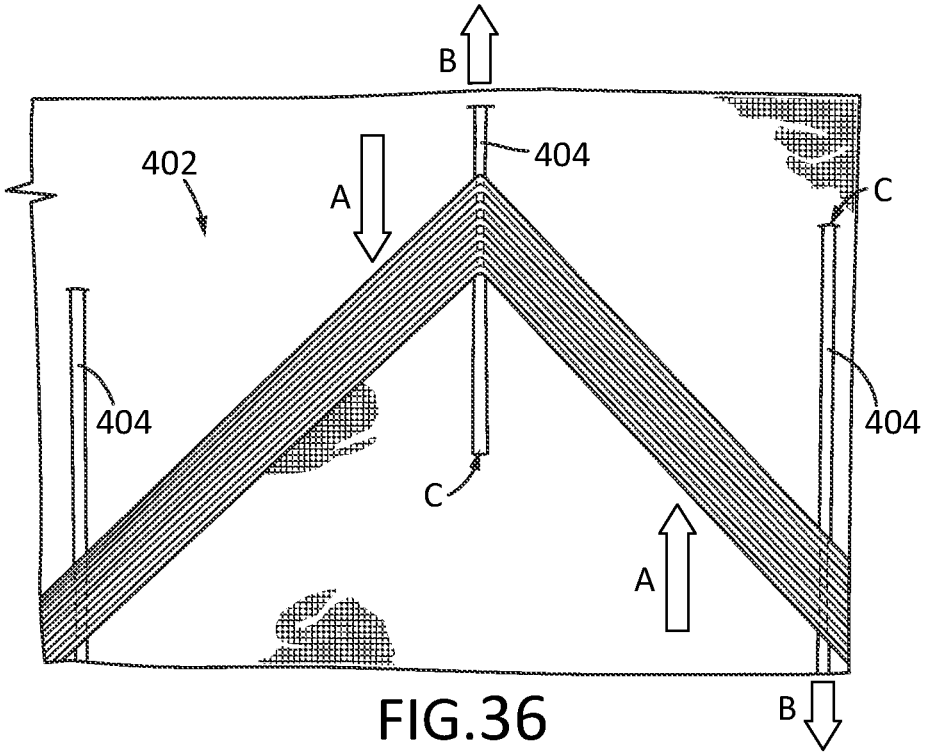
FIG. 36 is a schematic view showing an embodiment of a lymphatic band having a wedge shape.

In still another embodiment, as shown in FIGS. 33-36, the bands can be incorporated into sports clothing worn by a person to increase lymphatic drainage for the person. As shown in FIGS. 33-35, the sports clothing 400 can include multiple elastic chevrons or wedge shapes 402 attached on an inner surface of a cover layers to be in contact with the skin of the person. The wedge shapes 402 can adjust the fascial planes of the body by cupping the soft tissue to create more drag on the closed angle while decreasing drag on the open angle side. The friction created between the wedge shapes 402 and the skin, and the increased vector force on the closed angle side of the wedge shape 402 can effectively move the fascial plane in an open angle direction to a closed angle direction. Furthermore, additional elastic tension (pre-tensioned between a fixed point during the weaving process to create pull in one direction or the other depending on the characteristics of the tissue being affected) can be added to distort the wedge 402 into an elongated curved wedge or a shallower angled wedge to accommodate the amount of drag needed. For example, FIG. 36 shows a wedge 402 (made up of several elastic cords) attached to cords 404 in the sports clothing 400. The direction of tension post weaving when the stretch of elastic returns (shown by arrows A) and arrows B show the direction of the stretch. By fixing the superior portion of the elastic cords 404 at points C and stretching the inferior portion (shown by arrows B), the angle of the wedge 402 can be flattened. The converse is true when pre-tensioning occurs in opposite direction.

Figure 37:
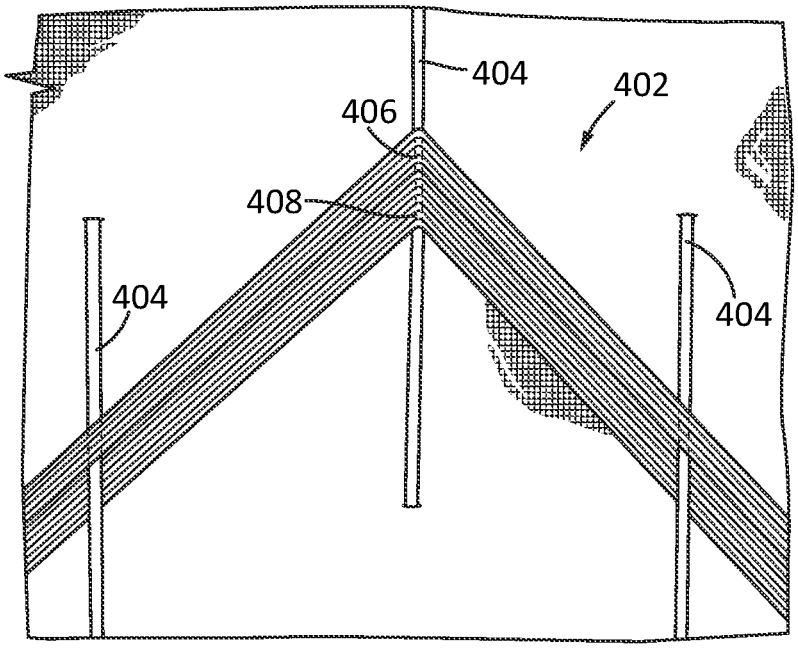
FIG. 37 is a schematic view showing an embodiment of a lymphatic band having a wedge shape.

As shown in FIG. 37, pre-tensioning of the wedges can occur based on the configuration of the elastic cords of the wedge 402 relative to the elastic cords (or anchor lines) 404. A first group of cords 406 can be lifted by anchor lines 404 on the open edge of the wedge for about ⅓ of the wedge width. A second group of cords 408 can be pressed down by anchor lines 404 passing on top of about ⅔ of wedge width in the closed angle of wedge. In an embodiment, the wedge placement in the clothing 400 is based on the fluid dynamics of the lymphatic system. The closed angle of the wedge 402 should be facing the heart, so as fluid is collected and pushed in the direction of the closed angle it is also pushed toward the heart so it can be absorbed by the circulatory system.

As will be apparent to one skilled in the art, various modifications can be made within the scope of the aforesaid description. Such modifications being within the ability of one skilled in the art form a part of the present invention and are embraced by the claims below.

What is claimed is:

1. A bra for limiting breast movement of a person during athletic activities, the bra comprising:

a base layer;

a band layer positioned on the base layer, the band layer comprising:

a primary band configured to be attached to the base layer at a midline of a back of the person, the primary band having a first end configured to extend from the midline of the back of the person and follow a first pathway that passes around a lower right rib cage, over a right breast, under a left breast and extends to a first attachment point, the primary band having a second end configured to extend from the midline of the back of the person and follow a second pathway that passes around a lower left rib cage, over the left breast, under the right breast and extends to a second attachment point, wherein the primary band is configured to limit oblique breast movement of the person; and a secondary band having a midpoint configured to be attached to the base layer at a midline of a sternum of the person, the secondary band having a first end configured to follow a third pathway starting from the midpoint of the secondary band and passing under the left breast, travelling to a left shoulder and extending to a third attachment point, the secondary band having a second end configured to follow a fourth pathway starting from the midpoint of the secondary band and passing under a right breast, travelling to a right shoulder and extending to a fourth attachment point, wherein the secondary band is configured to limit downward breast movement of the person; and a cover layer positioned over the band layer and the base layer.

2. The bra of claim 1, wherein the first attachment point is configured to be located at a left shoulder and the second attachment point is configured to be located at a right shoulder.

3. The bra of claim 1, wherein the first attachment point is located at a midpoint of the primary band and the second attachment point is located at the midpoint of the primary band.

4. The bra of claim 1, wherein the third attachment point is configured to be located at a left shoulder and the fourth attachment point is configured to be located at a right shoulder.

5. The bra of claim 1, wherein the third attachment point is configured to be located on a back of the person near the second pathway of the primary band and the fourth attachment point is configured to be located on the back of the person near the first pathway of the primary band.

6. The bra of claim 1, wherein the first pathway of the primary band and the second pathway of the primary band are configured to cross at a sternum of the person and are configured to be positioned on the sternum.

7. The bra of claim 1, wherein the base layer comprises a first pocket configured to receive the left breast and a second pocket configured to receive the right breast.

8. The bra of claim 7, wherein each of the first pocket and the second pocket have a first graduated compression region and a second graduated compression region, wherein the first graduated compression region is configured to be located closer to a chest of the person.

9. The bra of claim 7, wherein the base layer is configured to be in contact with a sternum of the person between the first pocket and the second pocket.

10. The bra of claim 1, wherein the primary band includes a plurality of elastic cords that are periodically woven in and out of the primary band, wherein the plurality of elastic cords are configured to help maintain the position of the primary band relative to the base layer.

11. The bra of claim 10, wherein the plurality of elastic cords are woven in and out of the primary band more frequently at pre-selected portions of the primary band.

12. The bra of claim 1, wherein the band layer further comprises a tertiary band, the tertiary band having a midpoint configured to be attached to the base layer at a midline of the back of the person above the primary band, the tertiary band having a first end configured to follow a fifth pathway configured to start from the midpoint of the tertiary band and pass around the right rib cage, up a right side of a chest of the person, over the right shoulder and extend to a fifth attachment point, the tertiary band having a second end configured to follow a sixth pathway configured to start from the midpoint of the tertiary band and pass around the left rib cage, up a left side of the chest of the person, over the left shoulder and extend to a sixth attachment point, wherein the tertiary band is configured to pull the left and right shoulders backwards.

13. The bra of claim 12, wherein a tension of the tertiary band is adjustable via at least one of the fifth attachment point or the sixth attachment point.

14. The bra of claim 1, wherein a tension of the primary band is adjustable via at least one of the first attachment point or the second attachment point.

15. The bra of claim 1, wherein a tension of the secondary band is adjustable via at least one of the third attachment point or the fourth attachment point.

16. The bra of claim 1, wherein the cover layer comprises a plurality of openings, wherein each opening of the plurality of openings provides access to one of the first attachment point, the second attachment point, the third attachment point or the fourth attachment point.

17. The bra of claim 1, wherein the first end of the primary band is adjustably attachable to the first attachment point, the second end of the primary band is adjustably attachable to the second attachment point, the first end of the secondary band is adjustably attachable to the third attachment point, and the second end of the secondary band is adjustably attachable to the fourth attachment point.

18. A bra for limiting breast movement of a person during athletic activities, the bra comprising:

a base layer;

a first primary band having a first starting point configured to be attached to the base layer at a midline of a back of the person, the first primary band configured to follow a first pathway starting from the first starting point and passing around a lower right rib cage, over a right breast, under a left breast and extending to a first attachment point;

a second primary band having a second starting point configured to be attached to the base layer at a midline of a back of the person, the second primary band configured to follow a second pathway starting from the second starting point and passing around a lower left rib cage, over the left breast, under the right breast and extending to a second attachment point, wherein the first primary band and the second primary band are configured to limit oblique breast movement of the person; and a secondary band having a midpoint configured to be attached to the base layer at a midline of a sternum of the person, the secondary band having a first end configured to follow a third pathway starting from the midpoint of the secondary band and passing under the left breast, travelling to a left shoulder and extending to a third attachment point, the secondary band having a second end configured to follow a fourth pathway starting from the midpoint of the secondary band and passing under a right breast, travelling to a right shoulder and extending to a fourth attachment point, wherein the secondary band is configured to limit downward breast movement of the person.

19. The bra of claim 18, further comprising a posture correcting band arrangement, the posture correcting band arrangement has a third band that is configured to start at an origin point near a top of a shoulder of the person, pass around the rib cage and expand into multiple bands that spread out and extend upward toward the origin point and the midline of the back, wherein the posture correcting band arrangement is configured to pull the shoulder and rib cage of the person forward.

20. The bra of claim 18, further comprising a posture correcting band arrangement, the posture correcting band arrangement has a third band that is configured to start at an origin point midway down the back of the person, pass around the rib cage, over the shoulder and expand into multiple bands that spread out and extend downward toward the origin point and the midline of the back, wherein the posture correcting band arrangement is configured to pull the shoulder and rib cage of the person backward.

* * * * *